US008256868B2

(12) United States Patent
Takahashi

(10) Patent No.: US 8,256,868 B2
(45) Date of Patent: Sep. 4, 2012

(54) IMAGE FORMING DEVICE AND IMAGE FORMING SYSTEM

(75) Inventor: Nozomu Takahashi, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 152 days.

(21) Appl. No.: 12/923,054

(22) Filed: Aug. 31, 2010

(65) Prior Publication Data

US 2011/0057979 A1 Mar. 10, 2011

(30) Foreign Application Priority Data

Sep. 10, 2009 (JP) ..... 2009-209635

(51) Int. Cl.
*B41J 29/38* (2006.01)

(52) U.S. Cl. ..... 347/16; 347/101

(58) Field of Classification Search ..... 347/1, 2, 347/5, 16, 101, 104, 105
See application file for complete search history.

(56) References Cited

U.S. PATENT DOCUMENTS 7,794,046 B2 * 9/2010 Baker ..... 347/40

FOREIGN PATENT DOCUMENTS

| | | |
|---|---|---|
| JP | 2908037 | 4/1999 |
| JP | 2008-221500 | 9/2008 |
| JP | 2010-105347 | 5/2010 |

OTHER PUBLICATIONS

Abstract of JP 04-223186 published Aug. 13, 1992.

* cited by examiner

*Primary Examiner* — Juanita D Jackson
(74) *Attorney, Agent, or Firm* — Harness, Dickey & Pierce, P.L.C.

(57) ABSTRACT

A location confirmation signal is transmitted from a feed paper carriage unit to a first image forming unit via a signal line and stored therein, a second location confirmation signal is transmitted from the first image forming unit to a second image forming unit and stored therein, and an n-th location confirmation signal is transmitted from an (n−1)-th image forming unit to a n-th image forming unit and stored therein.

8 Claims, 3 Drawing Sheets

IMAGE FORMING DEVICE AND IMAGE FORMING SYSTEM

CROSS-REFERENCE TO RELATED APPLICATIONS

The present application claims priority to and incorporates by reference the entire contents of Japanese Patent Application No. 2009-209635 filed in Japan on Sep. 10, 2009.

BACKGROUND OF THE INVENTION

1. Field of the Invention

The present invention generally relates to an image forming device and an image forming system.

2. Description of the Related Art

In recent years, as an ink jet type image forming device, an image forming device in, which an image forming portion is composed of a plurality of image forming units are disclosed in Japanese Patent Application Laid-open No. 2008-221500 and Japanese Patent Application Laid-open No. H04-223186.

In the image forming device disclosed in Japanese Patent Application Laid-open No. 2008-221500, an image forming portion is configured by connecting two image forming units in which an upstream side image forming unit prints a line image and a downstream side image forming unit prints a character image to form a complete image. Because the printing process is divided between two image forming units, it is possible to achieve high speed printing and increase the flexibility in image formation.

In the image forming device disclosed in Japanese Patent Application Laid-open No. H04-223186, a plurality of image forming units such as ink jet engines that eject an ink droplet is connected in removable manner. Types, number, and arrangement order of the image forming units are previously set and managed by a main control device. In the case where the number or the arrangement order is different from a set value, it is treated as an error.

In recent years, in the ink jet printer industry, demands for high-speed printing, high-resolution printing quality, and high-quality images have increased, and the demands (specifications) are diversified. If a different model is manufactured for each specification, manufacturing becomes complicated, or a development cost of each model increases. Further, there is a demand for an image forming device of which functions can be easily extended or changed, and it is also required to reduce machine downtime with the high speed operation.

SUMMARY OF THE INVENTION

It is an object of the present invention to at least partially solve the problems in the conventional technology.

According to an aspect of the present invention, there is provided an image forming device in which a feed paper carriage unit, one or more image forming units, and a discharge paper carriage unit are detachably connected to each other in a way from an upstream side to a downstream side in a transport direction of a recording medium, including: a signal line that is connected, in serial, from the feed paper carriage unit to the discharge paper carriage unit via the plurality of image forming units, wherein the feed paper carriage unit includes an interface unit and a control unit that controls to transmit an initial location confirmation signal by using the interface unit, to an image forming unit connected next to the feed paper carriage unit, each of the image forming unit includes a storage part that stores therein a location confirmation signal of the own image forming unit, an interface part that transmits the stored location confirmation signal, and a control part that when the control part of the image forming unit receives the initial location confirmation signal via the signal line, the control part recognizes that the own image forming unit is a first unit, generates and stores a first location confirmation signal in the storage part, and controls to transmit the first location confirmation signal by using the interface part to an the image forming unit connected next to the own image forming unit, when the control part of the image forming unit receives the first location confirmation signal via the signal line, the control part recognizes that the own image forming unit is a second unit, generates and stores a second location confirmation signal in the storage part, and controls to transmit the second location confirmation signal by using the interface part to an the image forming unit connected next to the own image forming unit, and when the control part of the image forming unit receives an (n−1)-th location confirmation signal via the signal line, the control part generates and stores an n-th location confirmation signal in the storage part, recognizes that the own image forming unit is an n-th unit, and controls to transmit the n-th location confirmation signal by using the interface part to the discharge paper carriage unit.

According to another aspect of the present invention, there is provided an image forming system that includes an image forming device in which a feed paper carriage unit, one or more image forming units, and a discharge paper carriage unit are detachably connected to each other in a way from an upstream side to a downstream side in a transport direction of a recording medium and a higher-level device that transmits printing data to the one or more image forming units of the image forming device, the image forming system includes: a signal line that is connected, in serial, from the feed paper carriage unit to the discharge paper carriage unit via the plurality of image forming units, wherein the feed paper carriage unit includes an interface unit, a control unit that controls to transmit a first location confirmation signal by using the interface unit, to an image forming unit connected next to the feed paper carriage unit, and a communication unit that transmits location confirmation signal of each of the image forming unit that is transmitted by each image forming unit, and connection number information of the image forming units to a higher-level device, each of the image forming unit includes a storage part that stores therein a location confirmation signal of the own image forming unit, an interface part that transmits the stored location confirmation signal, and a control part that when the control part of the image forming unit receives the initial location confirmation signal via the interface part, the control part recognizes that the own image forming unit is a first unit, generates and stores a first location confirmation signal in the storage part, and controls to transmit the first location confirmation signal by using the interface part to an the image forming unit connected next to the own image forming unit, when the control part of the image forming unit receives the first location confirmation signal via the interface part, the control part recognizes that the own image forming unit is a second unit, generates and stores a second location confirmation signal in the storage part, and controls to transmit the second location confirmation signal by using the interface part to an the image forming unit connected next to the own image forming unit, and when the control part of the image forming unit receives an (n−1)-th location confirmation signal via the interface part, the control part generates and stores an n-th location confirmation signal in the storage part, recognizes that the own image forming unit is an n-th unit, and controls to transmit the n-th location confirmation signal by using the interface part to the discharge paper carriage unit, and controls to transmit the location confirmation signal stored in the own storage part toward the feed paper carriage unit, and the discharge paper carriage unit includes an interface unit and a control unit that when receiving the n-th location confirmation signal, recognizes that n image forming units are connected, and controls to transmit connection number information of the image forming units by using the own interface unit toward the feed paper carriage unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an ink jet type image forming device and an image forming system according to an embodiment of the present invention will be described with reference to the accompanying drawings.

Figure 1:
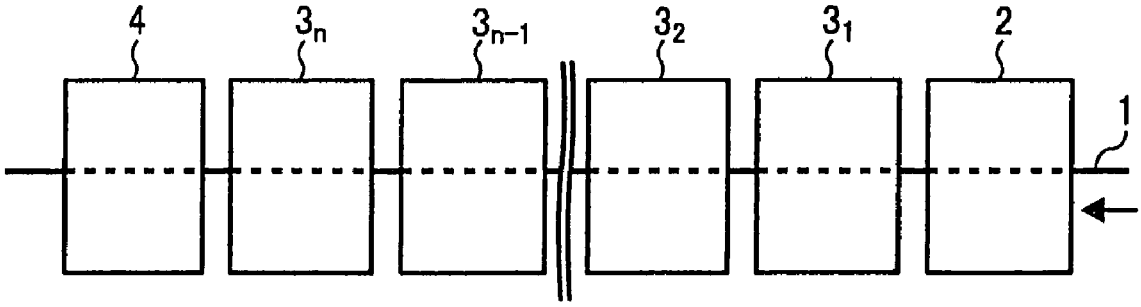
FIG. 1 is a schematic configuration diagram illustrating various units of an image forming device according to an embodiment of the present invention.

FIG. 1 is a schematic configuration diagram illustrating various units of an image forming device according to an embodiment of the present invention. In particular, FIG. 1 illustrates an example of a device that forms an image using an ink jet recording technique.

An image forming device includes a feed paper carriage unit 2, a plurality of image forming units $\mathbf{3}_1$ to $\mathbf{3}_n$ (n is an integer equal to or more than 2), and a discharge paper carriage unit 4 as illustrated in FIG. 1. The image forming device is configured by selecting and combining units from among the image forming units $\mathbf{3}_1$ to $\mathbf{3}_n$ according to the specification, at the time of factory shipment or at the time of upgrade at a user's place.

A detailed configuration will be described later, but the image forming units $\mathbf{3}_1$ to $\mathbf{3}_n$ have the same structure. Because the image forming units $\mathbf{3}_1$ to $\mathbf{3}_n$ according to the present embodiment employ an ink jet recording technique, an image forming portion is mainly composed of a cassette mounting portion, in which four ink cassettes are mounted, at an upper portion of a unit and four ink jet recording heads mounted below the cassette mounting portion.

As the ink cassettes, ink cassettes for yellow (Y), magenta (M), cyan (C), and black (K) are mounted. The ink cassettes of respective colors are individually connected to the four ink jet recording heads through ink supply tubes, and ink of each color is ejected from each ink jet recording head. An web 1 is transported near below the ink jet recording head, and ink is ejected from the ink jet recording head, thus color printing is performed on the web 1.

Further, when an image forming unit 3 is added, it is possible to increase the number of the ink cassettes mounted, that is, the number of the ink cassettes for yellow (Y), magenta (M), cyan (C), and black (K), and thus high-speed printing, high resolution printing quality, and high-quality images can be achieved. Further, when a special color ink cassette is added, it is possible to diversify colors. The feed paper carriage unit 2 and the discharge paper carriage unit 4 are common units mounted and used in each image forming device.

As illustrated in FIG. 1, the feed paper carriage unit 2, one or more image forming units 3 that are selected, and a discharge paper carriage unit 4 are disposed in the described order in a way from an upstream side to a downstream side in a transport direction of the web 1. Each unit is detachably connected.

Figure 2:
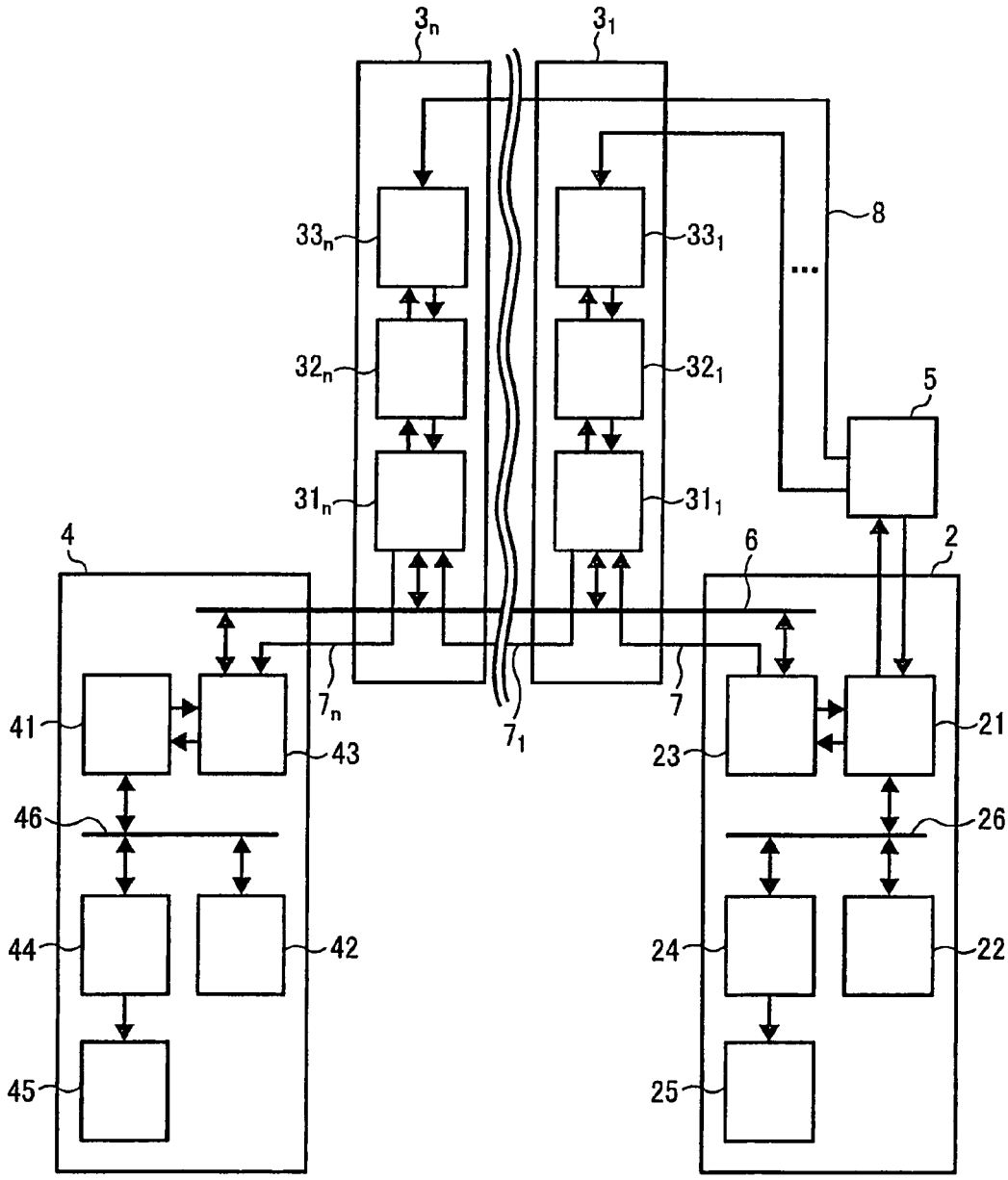
FIG. 2 is a block diagram illustrating a specified structure of an image forming device according to the embodiment, and a relationship between the image forming device and a higher-level device.

FIG. 2 is a block diagram illustrating a specified structure of an image forming device according to an embodiment of the present invention and a relationship between the image forming device and a higher-level device.

The feed paper carriage unit 2 includes: a central processing unit (CPU) 21 that controls a communication function with a higher-level device 5, a storage function (a random access memory (RAM) function), and also controls the whole unit; a non-volatile memory 22 that stores software for control; an interface unit 23 that performs communication with other units; and a feed paper transport driving circuit 24 that drive-controls a feed paper carriage driving unit 25. The paper carriage driving unit 25 is, for example, a motor for interlockingly operating the feed paper carriage unit 2 and a sensor. The CPU 21, the non-volatile memory 22, and the feed paper transport driving circuit 24 are connected with each other via a bus 26 in the feed paper carriage unit and exchange signals on an as-needed basis so that the feed paper carriage unit 2 can perform feed control of the web 1.

The discharge paper carriage unit 4 includes: a CPU 41 that controls the whole unit; a non-volatile memory 42 that stores software for control; an interface unit 43 that performs communication with other units; and a discharge paper carriage driving circuit 44 that drive-controls a discharge paper carriage driving unit 45. The discharge paper carriage driving unit 45 is, for example, a motor for interlockingly operating the discharge paper carriage unit 4 and a sensor. The CPU 41, the non-volatile memory 42, and the discharge paper transport driving circuit 44 are connected with each other via a bus 46 in the discharge paper carriage unit and exchange signals on an as-needed basis to perform discharge control of the web 1.

The image forming units $\mathbf{3}_1$ to $\mathbf{3}_n$ have the same structure as described above, and CPUs $\mathbf{32}_1$ to $\mathbf{32}_n$ in the image forming units $\mathbf{3}_1$ to $\mathbf{3}_n$ control image forming parts $\mathbf{33}_1$ to $\mathbf{33}_n$, each of which is composed of an ink cassette and an ink jet recording head which will be described below, and interface parts $\mathbf{31}_1$ to $\mathbf{31}_n$ that perform communication with other units and perform printing on the basis of printing data 8 transmitted from the higher-level device 5.

As illustrated in FIG. 2, the image forming units $\mathbf{3}_1$ to $\mathbf{3}_n$ are connected with each other via a serial signal line 6 through the interface unit 23 of the feed paper carriage unit 2, the interface parts $\mathbf{31}_1$ to $\mathbf{31}_n$ thereof, and the interface unit 43 of the discharge paper carriage unit 4, and share information with other units. The CPU 21 in the feed paper carriage unit 2, the CPUs $\mathbf{32}_1$ to $\mathbf{32}_n$ in the image forming units $\mathbf{3}_1$ to $\mathbf{3}_n$, and the CPU 41 in the discharge paper carriage unit 4 are controlled to operate in cooperation.

When transmitting printing data 8 from the higher-level device 5 to each of the image forming units $\mathbf{3}_1$ to $\mathbf{3}_n$, appropriate printing data 8 cannot be transmitted to each of the image forming units $\mathbf{3}_1$ to $\mathbf{3}_n$ in the case where the number of the image forming units $\mathbf{3}_1$ to $\mathbf{3}_n$ that are connected, mounting/ non-mounting information of the ink cassette, color information, and color arrangement information are cannot be determined. For this reason, the CPU 21 in the feed paper carriage unit 2 that performs communication with the higher-level device 5, transmits a location confirmation signal 7, which is an initial location signal, to the image forming unit 31 connected next to the discharge paper carriage unit 2 through the interface unit 23 when power is supplied.

Next, the CPU $\mathbf{32}_1$ of the image forming unit $\mathbf{3}_1$ receives the location confirmation signal 7 from the feed paper carriage unit 2, thereby recognizing that the own image forming unit $\mathbf{3}_1$ is an image forming unit located at a first position. The CPU $\mathbf{32}_1$ of the image forming unit $\mathbf{3}_1$ generates a location confirmation signal $\mathbf{7}_1$ which is a first location confirmation signal from the location confirmation signal 7, stores the location confirmation signal $\mathbf{7}_1$ in a storage part (RAM) in the CPU $\mathbf{32}_1$, and transmits the location confirmation signal $\mathbf{7}_1$ to an image forming unit $\mathbf{3}_2$ connected next to the image forming unit $\mathbf{3}_1$. The CPU $\mathbf{32}_2$ of the image forming unit $\mathbf{3}_2$ receives the location confirmation signal $\mathbf{7}_1$ from the image forming unit $\mathbf{3}_1$, thereby recognizing that the image forming unit $\mathbf{3}_2$ is an image forming unit located at a second position. The CPU $\mathbf{32}_2$ of the image forming unit $\mathbf{3}_2$ generates a location confirmation signal $\mathbf{7}_2$ which is a second location confirmation signal from the location confirmation signal $\mathbf{7}_1$, stores the location confirmation signal $\mathbf{7}_2$ in a storage part (RAM) in the CPU $\mathbf{32}_2$, and transmits the location confirmation signal $\mathbf{7}_2$ to the image forming unit $\mathbf{3}_3$ connected next to the image forming unit $\mathbf{3}_2$.

Hereinafter, each of the image forming units $\mathbf{3}_1$ to $\mathbf{3}_n$ can judge its own connection location using the sequentially received location confirmation signals. Finally, the CPU 41 of the discharge paper carriage unit 4 receives the location confirmation signal $\mathbf{7}_n$ from the n-th image forming unit $\mathbf{3}_n$. The CPU 41 of the discharge paper carriage unit 4 transmits information representing that the n image forming units are connected, that is, connection number information of the image forming units 3, to the feed paper carriage unit 2 through the interface unit 43 and the serial signal line 6.

At the same time, each of the CPU $\mathbf{32}_1$ to $\mathbf{32}_n$ of the image forming units $\mathbf{3}_1$ to $\mathbf{3}_n$ transmits the location confirmation signal thereof, mounting/non-mounting information of the ink cassette, color information, and color arrangement information to the feed paper carriage unit 2 on an as-needed basis. The CPU 21 of the feed paper carriage unit 2 stores these information in the storage part thereof.

Next, when the arrangement order (which includes connection number information of the image forming units $\mathbf{3}_1$ to $\mathbf{3}_n$) of the n image forming units $\mathbf{3}_1$ to $\mathbf{3}_n$, mounting/non-mounting information of the ink cassette, color information, and color arrangement information are reported, the CPU 21 of the feed paper carriage unit 2 transmits the information received to the higher-level device 5 through the communication unit of the CPU 21.

The higher-level device 5 determines whether the recommended arrangement condition is satisfied or not using the received information of the image forming units $\mathbf{3}_1$ to $\mathbf{3}_n$, and prepares to transmit the printing data 8 to the image forming units $\mathbf{3}_1$ to $\mathbf{3}_n$ when the arrangement condition is satisfied. On the contrary, when the recommend arrangement condition is not satisfied, such purport is notified to a user through a notifying unit (not shown) such as a display panel disposed in the higher-level device 5, and initiation of printing is stopped.

As an example that does not satisfy the recommended arrangement condition, there is a shortage of the image forming units 3. For example, the image forming units of at least four colors are required for color printing. When only the image forming units of three or less colors are connected, which do not satisfy the requirement, it is determined that the recommended arrangement condition is not satisfied.

As another example that does not satisfy the recommended arrangement condition is given. If an order in which the image forming units 3 are actually arranged is different from a recommended arrangement order, it is determined that the recommended arrangement order is not satisfied. For example, the recommended arrangement order of the image forming units 3 is decided as K-C-M-Y starting from an upper stream side in the transport direction of the web 1 from the viewpoint of printing quality in color printing.

In the case of the above-described example, the recommended arrangement condition for performing appropriate printing, such as that the image forming units 3 of four colors are necessary and that the arrangement order of the image forming units 3 is K-C-M-Y, is previously stored in a storage unit (not shown) of the higher-level device 5. The higher-level device 5 compares the arrangement condition with the information from the image forming units $\mathbf{3}_1$ to $\mathbf{3}_n$ (the feed paper carriage unit 2) to determine whether or not printing can be performed.

When it is determined that the recommended arrangement condition is not satisfied, initiation of printing is stopped. In addition, a comment such as "appropriate printing may not be performed in this configuration" is displayed on a panel (not shown) disposed in the higher-level device 5, or an alarming lamp using an LED is lighted, for example.

Figure 3:
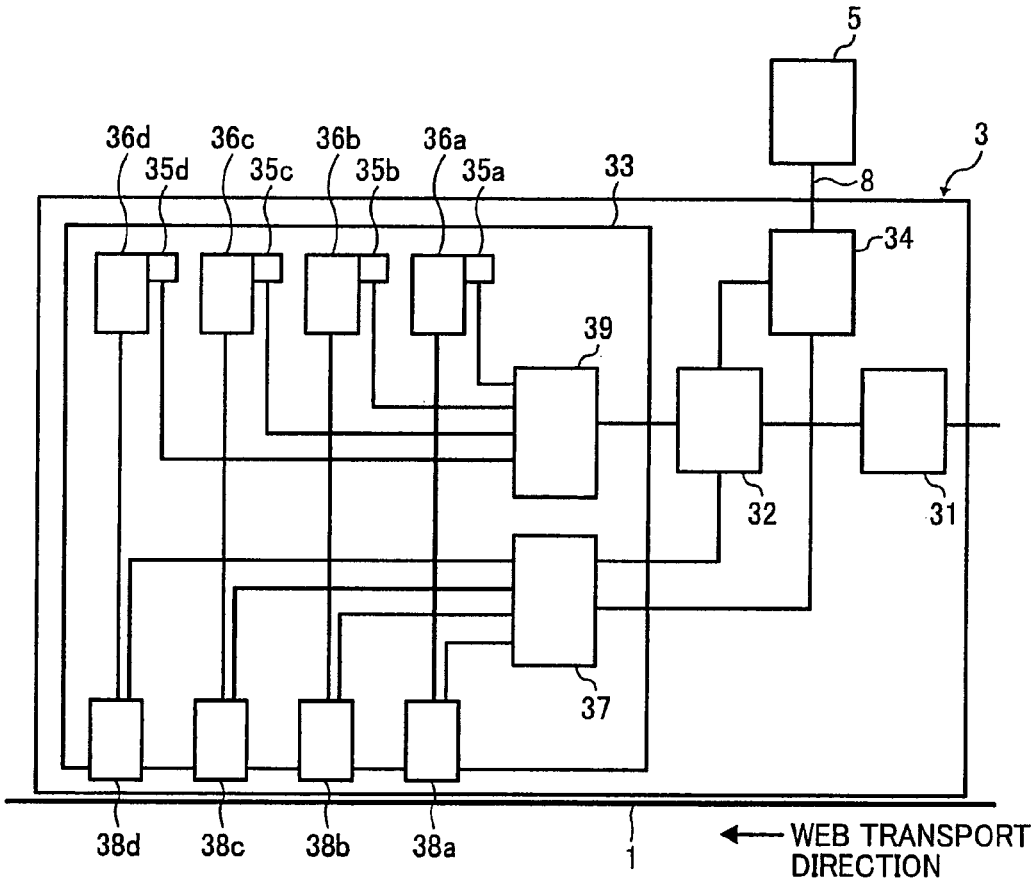
FIG. 3 is a block diagram illustrating the inside structure of an image forming unit according to the embodiment.

FIG. 3 is a block diagram illustrating the inside structure of an image forming unit according to the present embodiment. The image forming units 3 are connected in series in the transport direction of the web 1 and have the same structure so as to meet a specification on a user.

As illustrated in FIG. 3, ink cassettes 36*a* to 36*d* are detachably mounted at an upper portion of the image forming unit 3, and ink information identification ID (not shown) is attached to each of the ink cassettes 36*a* to 36*d*. Information of the ink information identification ID is read by each of ink cassette sensors 35*a* to 35*d* which are disposed, respectively, corresponding to the ink cassettes 36*a* to 36*d*, and is transmitted to and stored in an ink information acquiring circuit 39 on an as-needed basis. A CPU 32 transmits the read information of the ink information identification ID read and the above-described location confirmation signal to the feed paper carriage unit 2 through the interface part 31.

By reading the information of the ink information identification ID through each of the ink cassette sensors 35*a* to 35*d*, it is possible to recognize mounting/non-mounting information of the ink cassettes 36*a* to 36*d*, color information of ink which is loaded into each of ink jet recording heads 38*a* to 38*d*, and color arrangement information. The color arrangement information is recognizable from the arrangement of the ink jet recording heads 38*a* to 38*d* of respective colors such as yellow (Y), magenta (M), cyan (C), and black (K) from the upstream side to the downstream side in the transport direction of the web 1, and the color arrangement information is transmitted to the feed paper carriage unit 2. Further, the mounting/non-mounting information of the ink cassettes 36*a* to 36*d* can be judged according to whether or not each output of the each of the ink cassette sensors 35*a* to 35*d* is present.

Next, concrete examples of color arrangement information from the image forming units 3 will be described.

CONCRETE EXAMPLE 1

A case in which four image forming units $\mathbf{3}_1$ to $\mathbf{3}_4$ are connected First image forming unit: K-K-K-K
Second image forming unit: C-C-C-C
Third image forming unit: M-M-M-M
Fourth Image forming unit: Y-Y-Y-Y

CONCRETE EXAMPLE 2

A case in which four image forming units $3_1$ to $3_4$ are connected
First image forming unit: K-C-M-Y
Second image forming unit: K-C-M-Y
Third image forming unit: K-C-M-Y
Fourth Image forming unit: K-C-M-Y

CONCRETE EXAMPLE 3

A case in which two image forming units $3_1$ and $3_2$ are connected
First image forming unit: K-K-C-C
Second image forming unit: M-M-Y-Y

CONCRETE EXAMPLE 4

A case in which five image forming units $3_1$ to $3_5$ are connected
First image forming unit: K-K-K-K
Second image forming unit: C-C-C-C
Third image forming unit: M-M-M-M
Fourth image forming unit: Y-Y-Y-Y
Fifth image forming unit: S-S-S-S

CONCRETE EXAMPLE 5

A case in which five image forming units $3_1$ to $3_5$ are connected
First image forming unit: K-K-K-K
Second image forming unit: C-C-C-C
Third image forming unit: M-M-M-M
Fourth image forming unit: Y-Y-Y-Y
Fifth image forming unit: S1-S1-S2-S2

Incidentally, in the concrete examples, S, S1, and S2 represent special colors specially used by a user. As the color arrangement information from the image forming units 3, combinations other than the above-described concrete examples are also possible.

As described above, when power is supplied (before initiation of printing), each of the image forming units $3_1$ to $3_n$ recognizes what number is arranged thereto based on the location confirmation signal 7. A printing data selecting circuit 34 selects and receives printing data according to an instruction from the CPU 32, the selected data being necessary for a corresponding image forming unit 3 and being selected from among printing data 8 transmitted from the higher-level device 5 (see FIG. 3). An ink jet recording head driving circuit 37 converts the received printing data 8 into the driving signal of the ink jet recording heads 38*a* to 38*d* to drive the ink jet recording heads 38*a* to 38*d*, so that ink is ejected from each of the ink cassettes 36*a* to 36*d*.

In the above-described embodiment, each of the image forming units $3_1$ to $3_n$ transmits its own location confirmation signal, mounting/non-mounting information of the ink cassette, color information, and color arrangement information to the feed paper carriage unit 2, on an as-needed basis. The discharge paper carriage unit 4, which receives the location confirmation signal $7_n$ from the last image forming unit $3_n$, transmits the information representing that n image forming units are connected to the feed paper carriage unit 2 through the serial signal line 6. Then, the feed paper carriage unit 2 gathers the information and transmits them to the higher-level device 5. Alternatively, each of the image forming units $3_1$ to $3_n$ may transmit its own location confirmation signal, mounting/non-mounting information of the ink cassette, color information, and color arrangement information to the discharge paper carriage unit 4 on an as-needed basis, and the discharge paper carriage unit 4, which receives the location confirmation signal $7_n$ from the last image forming unit $3_n$, may gather the information and transmit them to the higher-level device 5.

The above-described embodiment has been describe in connection with an ink jet type image forming device, but the present invention is not limited thereto and can be applied to an image forming device of a different type such as an electronic photography type. When the present invention is applied to an electronic photography type image forming device, a toner cassette corresponds to the ink cassette, a toner cassette sensor disposed near the mounted toner cassette corresponds to an ink cassette sensor, and a developing head having a developing roller corresponds to the ink jet recording head.

According to the present invention, it is possible to provide an image forming device and an image forming system that can suppress an increase in a development cost originating from burden of developing a plurality of different models, provides high freedom in extension or change of functions of a device according to a specification, and can reduce machine downtime, which lead to a lower price image forming device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming device in which a feed paper carriage unit, a plurality of image forming units, and a discharge paper carriage unit are detachably connected to each other in a way from an upstream side to a downstream side in a transport direction of a recording medium, comprising:

a signal line that is connected, in serial, from the feed paper carriage unit to the discharge paper carriage unit via the plurality of image forming units, wherein the feed paper carriage unit comprises an interface unit and a control unit that controls to transmit an initial location confirmation signal by using the interface unit, to an image forming unit located next to the feed paper carriage unit, each of the image forming unit comprises a storage part that stores therein a location confirmation signal of the own image forming unit, an interface part that transmits the stored location confirmation signal, and a control part that when the control part of the image forming unit receives the initial location confirmation signal via the signal line, the control part recognizes that the own image forming unit is a first unit, generates and stores a first location confirmation signal in the storage part, and controls to transmit the first location confirmation signal by using the interface part to an image forming unit located next to the own image forming unit, when the control part of the image forming unit receives the first location confirmation signal via the signal line, the control part recognizes that the own image forming unit is a second unit, generates and stores a second location confirmation signal in the storage part, and controls to transmit the second location confirmation signal by using the interface part to the image forming unit located next to the own image forming unit, and when the control part of the image forming unit receives an (n−1)-th location confirmation signal via the signal line, the control part generates and stores an n-th location confirmation signal in the storage part, recognizes that the own image forming unit, is an n-th unit, and controls to transmit the n-th location confirmation signal by using the interface part to the discharge paper carriage unit.

2. The image forming device according to claim 1, wherein each of the image forming units further comprises:

a plurality of color material cassettes which is detachably mounted;

cassette sensors each of which is disposed corresponding to the each of color material cassettes, and detects mounting/non-mounting of a corresponding color material cassette and color of a color material loaded in the corresponding color material cassette; and a plurality of recording heads disposed corresponding to the color material cassettes, respectively, wherein the storage part stores therein mounting/non-mounting information of the color material cassette, color information of a color material, and color arrangement information which are obtained by the cassette sensor, and the control part controls to transmit the mounting/non-mounting information of the color material cassette, the color information of the color material, and the color arrangement information by using the interface part.

3. The image forming device according to claim 2, wherein the feed paper carriage unit or the discharge paper carriage unit comprises:

a storage part that receives and stores therein a location confirmation signal of the corresponding image forming unit transmitted from each of the image forming units, mounting/non-mounting information of the color material cassette, color information of the color material, color arrangement information, and connection number information of the image forming units that is transmitted from the last image forming unit among the connected image forming units; and a communication unit that transmits the location confirmation signal of the image forming unit, the mounting/non-mounting information of the color material cassette, the color information, the color arrangement information, and the connection number information of the image forming units to a higher-level device.

4. The image forming device according to claim 1, wherein each of the image forming unit further comprises a printing data selecting part that selects and receives printing data necessary for the own image forming unit from among printing data transmitted from a higher-level device on the basis of the location confirmation signal stored in the storage part.

5. An image forming system that includes an image forming device in which a feed paper carriage unit, a plurality of image forming units, and a discharge paper carriage unit are detachably connected to each other in a way from an upstream side to a downstream side in a transport direction of a recording medium and a higher-level device that transmits printing data to the plurality of image forming units of the image forming device, the image forming system comprises:

a signal line that is connected, in serial, from the feed paper carriage unit to the discharge paper carriage unit via the plurality of image forming units, wherein the feed paper carriage unit comprises an interface unit, a control unit that controls to transmit a first location confirmation signal by using the interface unit, to an image forming unit located next to the feed paper carriage unit, and a communication unit that transmits location confirmation signal of each of the image forming unit that is transmitted by each image forming unit, and connection number information of the image forming units to a higher-level device, each of the image forming units comprises a storage part that stores therein a location confirmation signal of the own image forming unit, an interface part that transmits the stored location confirmation signal, and a control part that when the control part of the image forming unit receives the initial location confirmation signal via the interface part, the control part recognizes that the own image forming unit is a first unit, generates and stores a first location confirmation signal in the storage part, and controls to transmit the first location confirmation signal by using the interface part to an image forming unit located next to the own image forming unit, when the control part of the image forming unit receives the first location confirmation signal via the interface part, the control part recognizes that the own image forming unit is a second unit, generates and stores a second location confirmation signal in the storage part, and controls to transmit the second location confirmation signal by using the interface part to the image forming unit located next to the own image forming unit, and when the control part of the image forming unit receives an (n−1)-th location, confirmation signal via the interface part, the control part generates and stores an n-th location confirmation signal in the storage part, recognizes that the own image forming unit is an n-th unit, and controls to transmit the n-th location confirmation signal by using the interface part to the discharge paper carriage unit, and controls to transmit the location confirmation signal stored in the own storage part toward the feed paper carriage unit, and the discharge paper carriage unit comprises an interface unit and a control unit that when receiving the n-th location confirmation signal, recognizes that n image forming units are connected, and controls to transmit connection number information of the image forming units by using the own interface unit toward the feed paper carriage unit.

6. The image forming system according to claim 5, wherein each of the image forming units further comprises:

a plurality of color material cassettes which is detachably mounted;

cassette sensors each of which is disposed corresponding to each of the color material cassettes, and detects mounting/non-mounting of a corresponding color material cassette and color of a color material loaded in the corresponding color material cassette; and a plurality of recording heads disposed corresponding to the color material cassettes, respectively, wherein the control part of each of the image forming units controls to transmit mounting/non-mounting information of the color material cassette, color information of a color material, and color arrangement information which are obtained by the cassette sensor, toward the feed paper carriage unit together with the location confirmation signal, and the communication unit of the feed paper carriage unit transmits toward the higher-level device, the mounting/non-mounting information of the color material cassette, the color information of the color material, and the color arrangement information to the higher-level device together with the location confirmation signal of each image forming unit, as well as the connection number information of the image forming units.

7. The image forming system according to claim 6, wherein the higher-level device previously stores a recommended arrangement condition of the image forming unit which is desirable for performing appropriate printing, compares information of the image forming unit transmitted from the feed paper carriage unit with the recommended arrangement condition, and when it is determined that the information does not satisfy the recommended arrangement condition, stops initiation of printing and notifies that the information does not satisfies the recommended arrangement condition.

8. The image forming system according to claim 5, wherein each of the image forming units further comprises a printing data selecting part that selects and receives printing data necessary for the own image forming unit from among printing data transmitted from the higher-level device on the basis of the location confirmation signal stored in the storage part.

* * * * *